US010107077B2

(12) United States Patent
Settle

(10) Patent No.: US 10,107,077 B2
(45) Date of Patent: Oct. 23, 2018

(54) WELL CLEANING SYSTEM

(71) Applicant: Troy Settle, Edmond, OK (US)

(72) Inventor: Troy Settle, Edmond, OK (US)

( * ) Notice: Subject to any disclaimer, the term of this patent is extended or adjusted under 35 U.S.C. 154(b) by 217 days.

(21) Appl. No.: 14/962,158

(22) Filed: Dec. 8, 2015

(65) Prior Publication Data

US 2017/0159409 A1 Jun. 8, 2017

(51) Int. Cl.
*E21B 37/02* (2006.01)
*E21B 17/20* (2006.01)

(52) U.S. Cl.
CPC ..... *E21B 37/02* (2013.01); *E21B 17/20* (2013.01)

(58) Field of Classification Search
CPC ..... E21B 37/00; E21B 27/00; E21B 27/005; E21B 37/02
See application file for complete search history.

(56) References Cited

U.S. PATENT DOCUMENTS 2,099,877 A * 11/1937 Westall ..... E21B 27/00 166/109
2,674,318 A * 4/1954 Sutliff ..... E21B 27/00 137/844
2,692,160 A * 10/1954 Miller ..... E21B 27/00 166/148
2,728,599 A * 12/1955 Moore ..... E21B 27/00 166/164
2,732,250 A * 1/1956 Wise ..... E21B 27/00 166/222
4,505,341 A * 3/1985 Moody ..... E21B 21/00 166/105.1
4,515,212 A * 5/1985 Krugh ..... E21B 27/00 166/170
4,711,299 A * 12/1987 Caldwell ..... E21B 37/00 166/105.1
4,747,452 A 5/1988 Clark
4,940,092 A * 7/1990 Ferguson ..... E21B 27/00 166/105.2
5,095,976 A 3/1992 Appleton
5,139,089 A * 8/1992 Wacker ..... E21B 17/07 166/105.3
5,447,200 A * 9/1995 Dedora ..... E21B 17/1057 166/105
7,878,247 B2 2/2011 Misselbrook et al.
7,891,419 B2 * 2/2011 Shewchuk ..... E21B 37/10 166/105.3
7,987,906 B1 8/2011 Troy
D684,660 S 6/2013 Rogers et al.
(Continued)

*Primary Examiner* — Kipp C Wallace

(57) ABSTRACT

A well cleaning system includes a well bore that has a vertical section and a horizontal section. A workover rig is positioned over the well bore and the workover rig includes a plurality of flexible tubes. The flexible tubes are coupled together to form a line. The line is coupled to the workover rig such that the workover rig urges the line into the horizontal section of the well bore. A perforated pipe is fluidly coupled between a selected pair of the flexible tubes. Thus, the perforated pipe may equalize a pressure between the horizontal section and the workover rig thereby facilitating debris to enter the line when the line is urged into the well bore. A cleanout unit is coupled to the line. The cleanout unit agitates the debris in the horizontal section thereby facilitating the debris to enter the flexible pipes when the line is urged into the well bore.

1 Claim, 6 Drawing Sheets

(56) References Cited

U.S. PATENT DOCUMENTS

| | | | | |
|---|---|---|---|---|
| 2011/0024112 | A1* | 2/2011 | Ford | E21B 37/00<br>166/278 |
| 2014/0116712 | A1 | 5/2014 | Bansal et al. | |

* cited by examiner

WELL CLEANING SYSTEM

BACKGROUND OF THE DISCLOSURE

FIELD OF THE DISCLOSURE

The disclosure relates to cleaning devices and more particularly pertains to a new cleaning device for removing debris from a horizontal section of a well bore.

SUMMARY OF THE DISCLOSURE

An embodiment of the disclosure meets the needs presented above by generally comprising a well bore that has a vertical section and a horizontal section. A workover rig is positioned over the well bore and the workover rig includes a plurality of flexible tubes. The flexible tubes are coupled together to form a line. The line is coupled to the workover rig such that the workover rig urges the line into the horizontal section of the well bore. A perforated pipe is fluidly coupled between a selected pair of the flexible tubes. Thus, the perforated pipe may equalize a pressure between the horizontal section and the workover rig thereby facilitating debris to enter the line when the line is urged into the well bore. A cleanout unit is coupled to the line. The cleanout unit agitates the debris in the horizontal section thereby facilitating the debris to enter the flexible pipes when the line is urged into the well bore.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
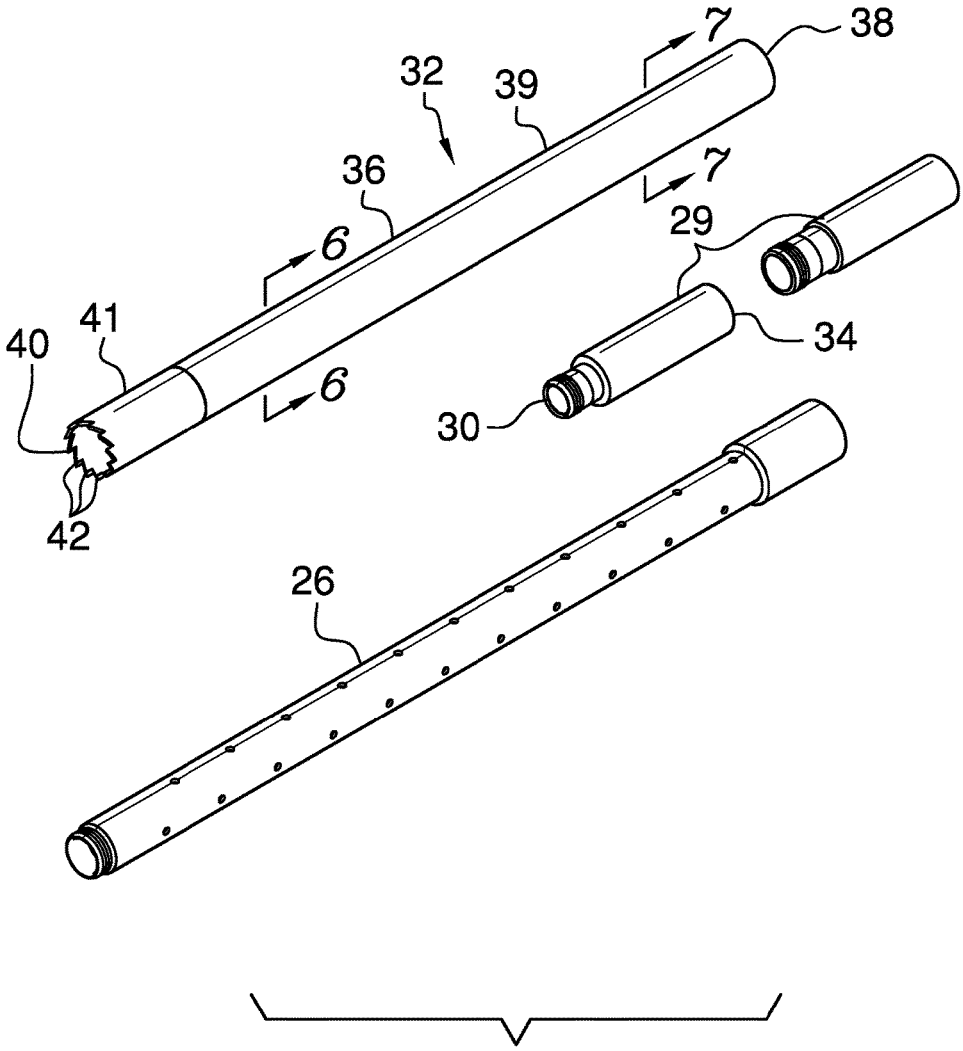
FIG. 1 is a perspective view of a well cleaning system according to an embodiment of the disclosure.
Figure 2:
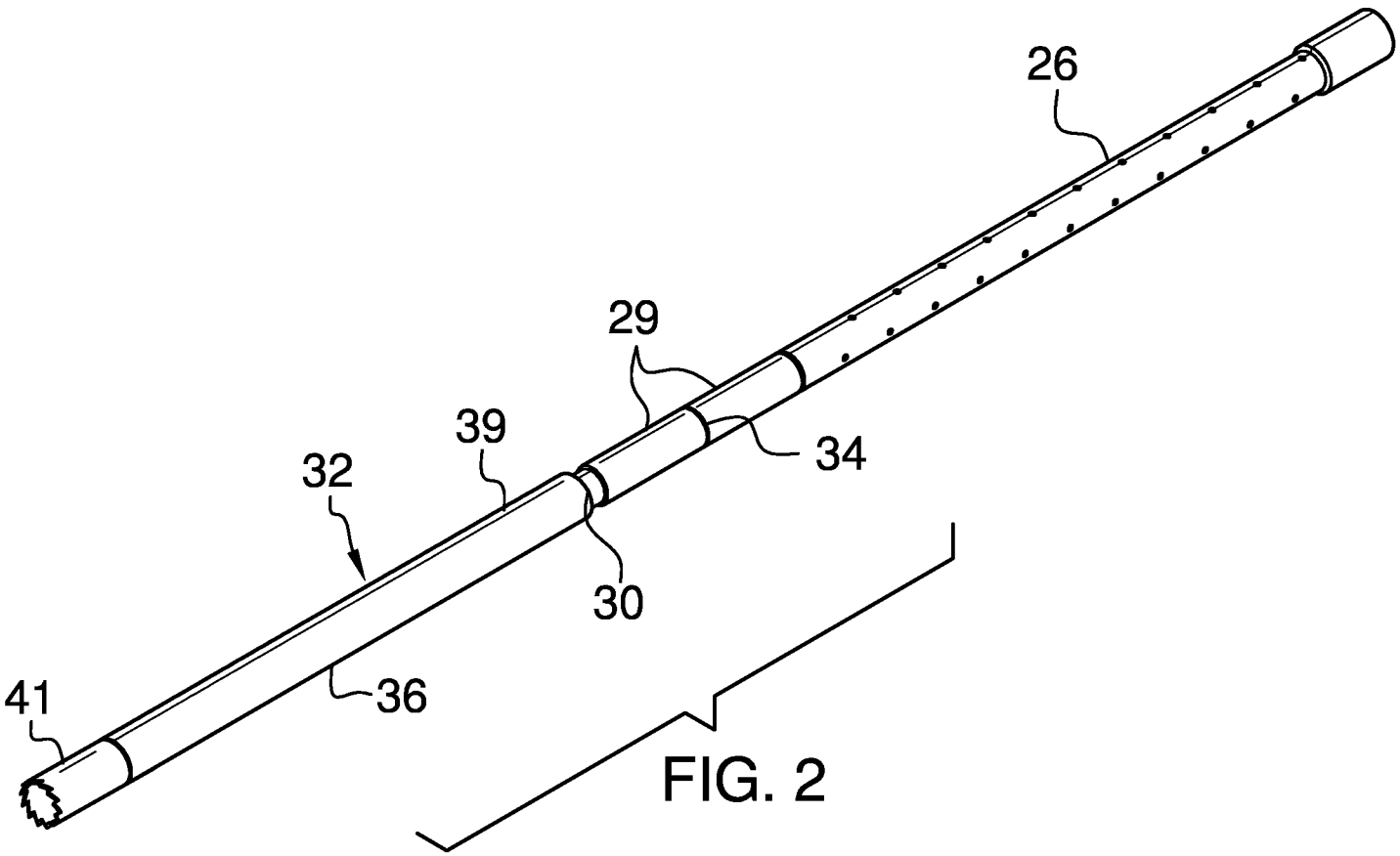
FIG. 2 is a front perspective view of an embodiment of the disclosure.
Figure 3:
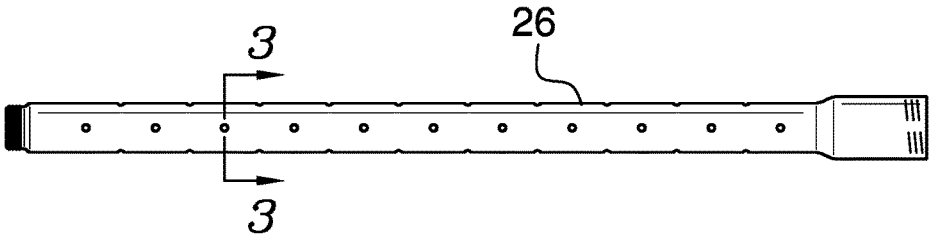
FIG. 3 is a right side view of an embodiment of the disclosure.
Figure 4:
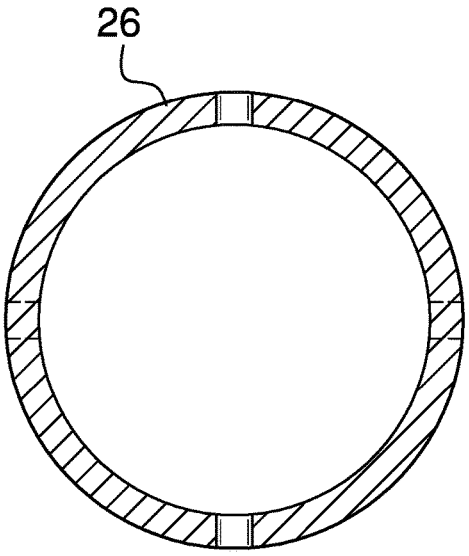
FIG. 4 is a cross sectional view taken alone line 4-4 of FIG. 3 of an embodiment of the disclosure.
Figure 5:
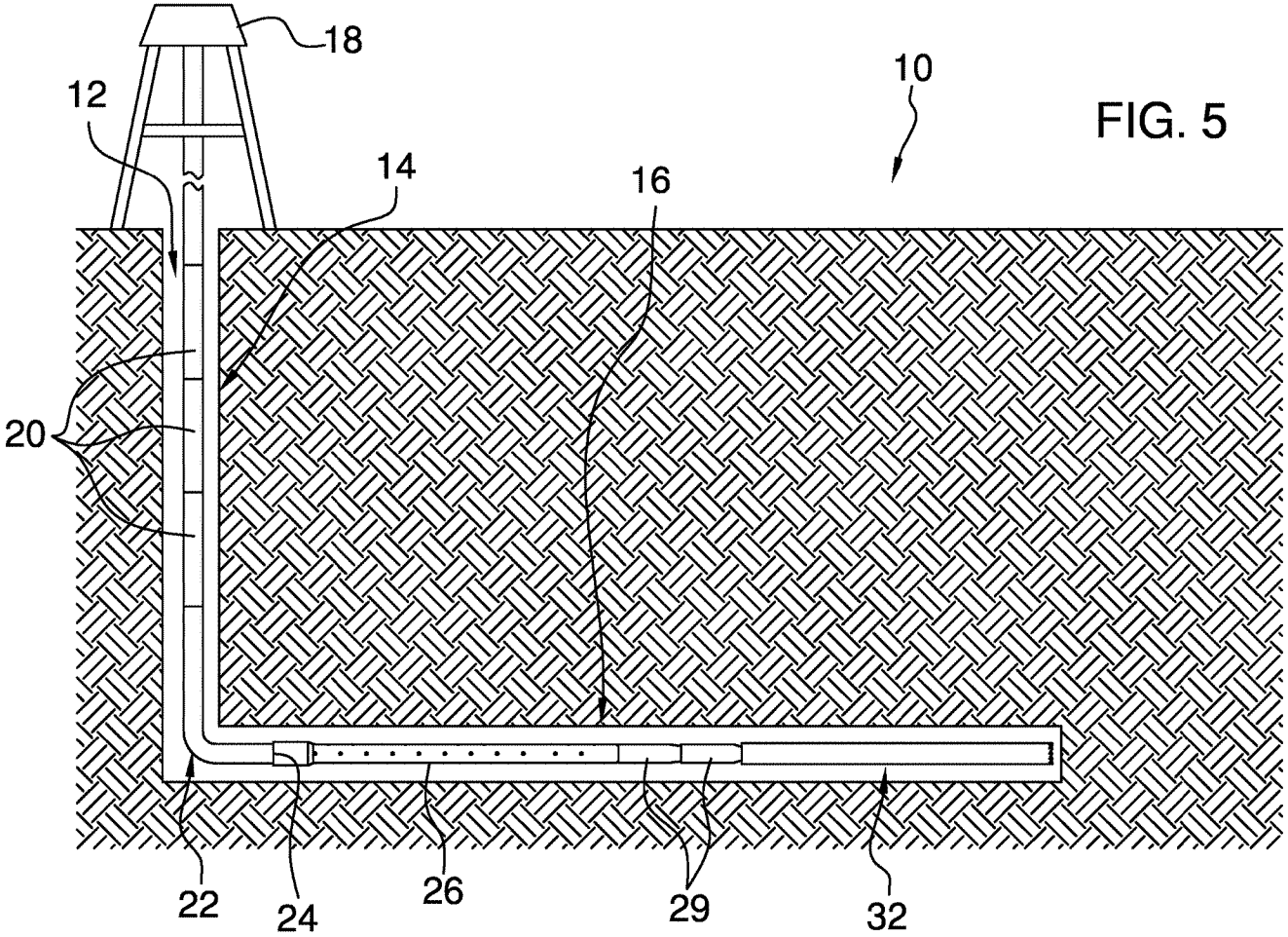
FIG. 5 is a perspective in-use view of an embodiment of the disclosure.
Figure 6:
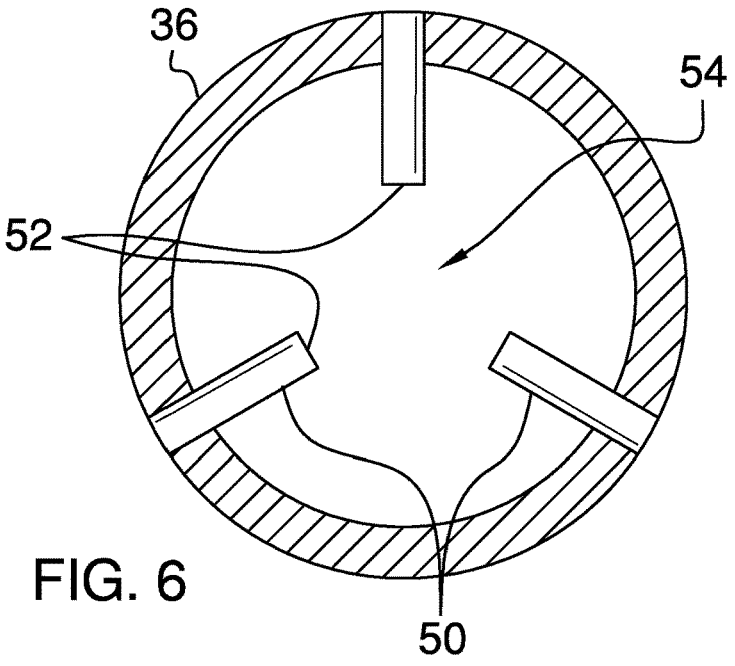
FIG. 6 is a cross sectional view taken along line 6-6 of FIG. 1 of an embodiment of the disclosure.
Figure 7:
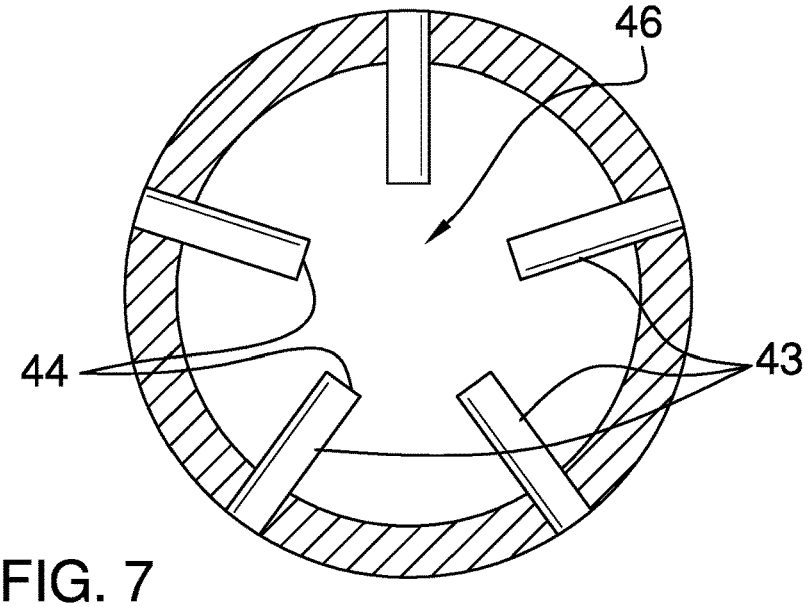
FIG. 7 is a cross sectional view taken along line 7-7 of FIG. 1 of an embodiment of the disclosure.
Figure 8:
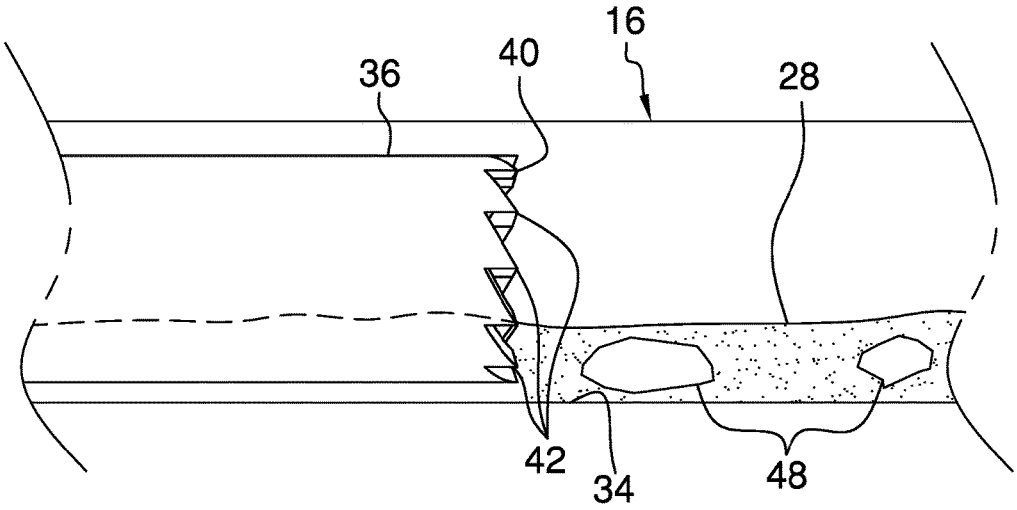
FIG. 8 is a perspective in-use view of a cleanout pipe in a horizontal section of an embodiment of the disclosure.

With reference now to the drawings, and in particular to FIGS. 1 through 8 thereof, a new cleaning device embodying the principles and concepts of an embodiment of the disclosure and generally designated by the reference numeral 10 will be described.

As best illustrated in FIGS. 1 through 8, the well cleaning system 10 generally comprises a well bore 12 that has a vertical section 14 and a horizontal section 16. The horizontal section 16 is positioned below ground and the well bore 12 may comprise a fracking well or the like. A workover rig 18 is positioned over the well bore 12 and the workover rig 18 includes a plurality of flexible tubes 20. The flexible tubes 20 are coupled together to form a line 22. The line 22 is coupled to the workover rig 18 such that the workover rig 18 urges the line 22 into the horizontal section 16 of the well bore 12. The line 22 has a distal end 24 with respect to the workover rig 18. The workover rig 18 may be a workover rig of any conventional design utilized in the convention of oil well intervention.

A perforated pipe 26 is fluidly coupled between a selected pair of the flexible tubes 20. The perforated pipe 26 equalizes pressure between the horizontal section 16 and the workover rig 18. Thus, debris 28 may enter the flexible tubes 20 when the line 22 is urged into the well bore 12. The perforated pipe 26 allows a fluid to drain from the flexible tubes 20 when the line 22 is removed from the well bore 12. Thus, the fluid is inhibited from spilling out of the well bore 12 when the line 22 is removed from the well bore 12. The perforated pipe 26 may comprise a perforated sub of any conventional design utilized in the convention of oil well intervention.

At least one check valve 29 is provided and the at least one check valve 29 has an inlet 30 and an outlet 34. The outlet 34 is removably coupled to the distal end 24 of the line 22 such that the at least one check valve 29 is in fluid communication with the flexible tubes 20. The at least one check valve 29 facilitates the debris 28 to flow from the inlet 30 to the outlet 34. Thus, the debris 28 may enter the flexible tubes 20 when the line 22 is urged into the well bore 12. The well bore 12 may have an inside diameter ranging between approximately ten cm and fifteen cm. Each of the flexible tubes 20, the perforated pipe 26 and the at least one check valve 29 may have an outside diameter ranging between approximately eight cm and thirteen cm.

The at least one check valve 29 inhibits the debris 28 from flowing from the outlet 34 to the inlet 30. Thus, the debris 28 is retained in the flexible tubes 20 when the line 22 is removed from the well bore 12. The at least one check valve 29 may comprise a check valve utilized in the convention of oil well intervention. Additionally, the at least one check valve 29 may comprise a check valve manufactured by Bulldog Specialties, LTD, 1312 W $2^{nd}$ ST, Odessa, Tex., 79763 or the like.

A cleanout unit 32 is coupled to the line 22 and the cleanout unit 32 agitates the debris 28 in the horizontal section 16. Thus, the debris 28 may enter the flexible tubes 20 when the line 22 is urged into the well bore 12. The debris 28 may comprise fracking sand or the like and the debris 28 may collect on a lower surface 34 of the horizontal section 16. The debris 28 may be compacted or otherwise resiliently maintained within the horizontal section 16.

The cleanout unit 32 comprises a cleanout pipe 36 that has a first end 38 and a second end 40. The first end 38 is coupled to the at least one check valve 29 such that the cleanout pipe 36 is in fluid communication with the flexible tubes 20. The second end 40 comprises a plurality of teeth 42. The teeth 42 are spaced apart from each other and distributed around the second end 40. The teeth 42 frictionally engage the debris 28 in the horizontal section 16. Thus, the debris 28 is agitated and dislodged on the lower surface 34 of the horizontal section 16.

The cleanout pipe 36 is urged along the horizontal section 16 and the cleanout pipe 36 funnels the debris 28 into the flexible tube 22. The cleanout pipe 36 may have an outside diameter ranging between approximately eight cm and thirteen cm. Thus, the cleanout pipe 36 inhibits the debris 28 from passing between the cleanout pipe 36 and a bounding surface of the well bore 12. The cleanout pipe 36 may have an inside diameter ranging between five cm and seven cm. Thus, the debris 28 may move freely through the cleanout pipe 36. The cleanout pipe 36 may comprise a first half 39 that is threadably coupled to a second half 41.

A plurality of first wires 43 is provided and each of the first wires 43 is coupled to the cleanout pipe 36. Each of the first wires 43 extends into an interior of the cleanout pipe 36. The first wires 43 are positioned closer to the first end 38 than the second end 40. Thus, the first wires 43 may be positioned in the first half 39 of the cleanout pipe 36. The first wires 43 are spaced apart from each other and distributed around a circumference of the cleanout pipe 36. Thus, the debris 28 may pass through the first wires 43. The plurality of first wires 43 may comprise between approximately five first wires 43 and seven first wires 43.

Each of the first wires 43 has a distal end 44 with respect to an inner surface 46 of the cleanout pipe 36. The distal end 44 of each of the first wires 43 is spaced apart from each other to form an opening 46 between the first wires 43. Each of the first wires 43 may capture objects 48 thereby inhibiting the objects 48 from entering the at least one check valve 29. The objects 48 may comprise rocks or other objects that are larger than the opening 46. Additionally, the objects 48 may be capable of inhibiting the at least one check valve 29 from closing if the objects 48 enter the at least one check valve 29.

A plurality of second wires 50 is provided and each of the second wires 50 is coupled to the cleanout pipe 36. Each of the second wires 50 extends into an interior of the cleanout pipe 36. The second wires 50 are positioned closer to the second end 40 than the first end 38. Thus, the second wires 50 may be positioned in the second half 41 of the cleanout pipe 36. The second wires 50 are spaced apart from each other and distributed around a circumference of the cleanout pipe 36. Thus, the debris 28 may pass through the second wires 50. The plurality of second wires 50 may comprise between approximately three second wires 50 and five second wires 50.

Each of the second wires 50 has a distal end 52 with respect to the inner surface 46 of the cleanout pipe 36. The distal end 52 of each of the second wires 50 is spaced apart from each other to form an opening 54 between the second wires 50. The objects 48 pass through the second wires 50 when the cleanout pipe 36 is urged into the well bore 12. The second wires 50 inhibit the objects 48 from passing through the opening 54 between the second wires 50 when the cleanout pipe is removed from the well bore 12. Thus, each of the second wires 50 may capture the objects 48 thereby inhibiting the objects 48 from exiting the cleanout pipe 36 when the line 22 is removed from the well bore 12.

In use, the perforated pipe 26 is positioned at a point being approximately seventy meters from the distal end 24 of the line 22. Thus, the debris 28 may be contained within the flexible tubes 20 located between the perforated pipe 26 and the distal end 24 of the line 22. The at least one check valve 30 is coupled to the distal end 24 of the line 22 and the cleanout pipe 36 is coupled to the at least one check valve 30. The line 22 is urged into the well bore 12 and the teeth 42 agitate the debris 28 in the horizontal section 16. The cleanout pipe 36 funnels the debris 28 into the flexible tubes 20 as the line 22 is urged into the well bore 12.

The line 22 is urged into the well bore 12 until the cleanout pipe 36 reaches a terminal end of the horizontal section 16. The line 22 is urged outwardly from the well bore 12 when the cleanout pipe 36 reaches the terminal end. The at least one check valve 30 closes when the line 22 is urged outwardly from the well bore 12. Thus, the debris 28 is retained within the flexible tubes 20 thereby facilitating the debris 28 to be removed from the well bore 12. The first wires 43 and the second wires 50 retain the objects 48 within the cleanout pipe 36 when the line 22 is removed from the well bore 12. Thus, the objects 48 are removed from the well bore 12.

The cleanout pipe 36 is removed from the line 22 when the line 22 is removed from the well bore 12. The at least one check valve 30 is removed from the line 22 and the debris 28 is emptied from the line 22. The first half 39 of the cleanout pipe 36 is uncoupled from the second half 41 of the cleanout pipe 36. Thus, the objects 48 are removed from the cleanout pipe 36.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A well cleaning system comprising:

a well bore having a vertical section and a horizontal section;

a workover rig being positioned over said well bore, said workover rig including a plurality of flexible tubes, said flexible tubes being coupled together to form a line, said line being coupled to said workover rig such that said workover rig urges said line into said horizontal section of said well bore, said line having a distal end with respect to said workover rig;

a perforated pipe being fluidly coupled between a selected pair of said flexible tubes wherein said perforated pipe is configured to equalize a pressure between said horizontal section and said workover rig thereby facilitating debris to enter said line when said line is urged into said well bore;

at least one check valve having an inlet and an outlet, said at least one check valve being removably coupled to said distal end of said line such that said at least one check valve is in fluid communication with said flexible tubes, said at least one check valve being configured to facilitate the debris to flow from said inlet to said outlet thereby facilitating the debris to enter said flexible tubes when said line is urge into said well bore, said at least one check valve being configured to inhibit the debris from flowing from said outlet to said inlet thereby facilitating the debris to be retained in said flexible tubes when said line is removed from said well bore; and a cleanout unit being coupled to said line, said cleanout unit being configured to agitate the debris in said horizontal section thereby facilitating the debris to enter said flexible pipes when said line is urged into said well bore, said cleanout unit comprising: a cleanout pipe having a first end and a second end, said first end being coupled to said at least one check valve such that said cleanout pipe is in fluid communication with said flexible tubes, said second end comprising a plurality of teeth wherein said teeth are configured to frictionally engage the debris in said horizontal section thereby facilitating the debris to be dislodged from said horizontal section, said cleanout pipe being urged along said horizontal section wherein said cleanout pipe is configured to funnel the debris into said flexible tube, a plurality of first wires, each of said first wires being coupled to said cleanout pipe, each of said first wires extending into an interior of said cleanout pipe, each of said first wires being positioned closer to said first end than said second end, said first wires being spaced apart from each other and distributed around a circumference of said cleanout pipe, each of said first wires having a distal end with respect to an inner surface of said cleanout pipe, said distal end of each of said first wires being detached from the cleanout pipe, each of said first wires being configured to capture objects thereby inhibiting said objects from entering said at least one check valve, and a plurality of second wires, each of said second wires being coupled to said cleanout pipe, each of said second wires extending into an interior of said cleanout pipe, each of said second wires being positioned closer to said second end than said first end, said second wires being spaced apart from each other and distributed around a circumference of said cleanout pipe, each of said second wires having a distal end with respect to an inner surface of said cleanout pipe, said distal end of each of said second wires being detached from the cleanout pipe, each of said second wires being configured to capture the objects thereby inhibiting the objects from exiting said cleanout pipe when said line is removed from said well bore, wherein the second wires outnumber the first wires.

* * * * *